US005937610A

United States Patent [19]

Behunin

[11] Patent Number: 5,937,610

[45] Date of Patent: Aug. 17, 1999

[54] METHOD OF FORMING A STRUCTURAL BLOCK OR BRICK WALL

[76] Inventor: Gage Behunin, 1901 Leroy Dr., #8, Northglenn, Colo. 80233

[21] Appl. No.: 09/032,447

[22] Filed: Feb. 27, 1998

[51] Int. Cl.[6] ..... E04G 21/02; E04G 11/08

[52] U.S. Cl. ..... 52/741.1; 52/745.1; 52/747.12; 52/749.13

[58] Field of Search ..... 52/741.1, 747.12, 52/745.1, 749.13

[56] References Cited

U.S. PATENT DOCUMENTS

| | | | |
|---|---|---|---|
| 1,779,007 | 10/1930 | Makowski | 52/747.12 |
| 3,817,006 | 6/1974 | Williams | 52/747.12 X |
| 3,844,075 | 10/1974 | Tolleson et al. | 52/747.12 X |
| 4,622,796 | 11/1986 | Aziz et al. | 52/747.12 |

*Primary Examiner*—Christopher Kent
*Attorney, Agent, or Firm*—Edwin H. Crabtree; Ramon L. Pizarro; Donald W. Margolis

[57] ABSTRACT

A method of forming a structural wall using lightweight or heavyweight block or brick. A removable lightweight wall panel is used as a guide for forming the wall. The method includes first installing the removable wall panel vertically next to a chalk line on the foundation. The chalk line is used to mark a horizontal line along one side of the wall to be constructed. The wall panel is plumbed vertically and leveled horizontally. The wall panel includes horizontal level lines 8 inches, 2 feet and 6 feet from a bottom of the wall panel. The level lines are used as a level guide to make sure each row or course of blocks are level as a block wall is built upwardly. A bonding agent is now placed on the bottom and on one end of a plurality of concrete blocks for forming a first course of blocks. The blocks are then laid end to end next to each other and next to one side of the wall panel for forming a first row of blocks. The bonding agent is then applied to the top of the first course of blocks. The bonding agent is now applied to the ends of a plurality of concrete blocks for forming a second course of blocks. The blocks are then laid end to end next to each other on top of the first course of blocks for forming a second course of blocks. The applying of the bonding agent to the blocks and laying courses of blocks one on top of each other is continued upwardly until the top of the last course of blocks coincides with the top of the wall panel.

15 Claims, 3 Drawing Sheets

METHOD OF FORMING A STRUCTURAL BLOCK OR BRICK WALL

BACKGROUND OF THE INVENTION (a) Field of the Invention

This invention relates to a new method of building wall construction and more particularly, but not by way of limitation, to a method of forming a structural block or brick wall.

(b) Discussion of Prior Art

Heretofore, brick and block masonry walls have been built by hand, one brick or block at a time. The wall was erected using hand tools for applying mortar on the sides and on the tops of the bricks or blocks. The mortar was mixed on site. This type of wall construction is labor intensive, it is expensive, it is time consuming, it requires mixing mortar on site and it requires skilled masons for well constructed walls.

Also, brick and block walls have been preconstructed by forming walls in forms on a horizontal surface on a job site. When the wall is completed, the wall is hoisted upwardly using heavy equipment into a vertical position and attached to a side of a building. This method of wall construction is also time consuming and expensive when having to use additional equipment for lifting each completed wall into place.

The subject invention as described herein eliminates the above mentioned problems related to brick and block wall construction. The new method of wall construction allows unskilled brick layers to build a brick or block wall. The method takes half the time when compared to building brick and block walls using mortar and hand tools thereby greatly reducing the overall cost of building construction.

SUMMARY OF THE INVENTION

In view of the foregoing, it is a primary objective of the subject method of forming a structural wall to greatly reduce the time required to build either a brick or block wall. The reduced time being in an order of up to half of what is normally required in standard brick and block wall construction using mortar and mason hand tools.

Another object of the invention is to eliminate the need for mortar, the mixing of mortar and eliminating mortar clean up after the wall is built. No pre-stocking of mortar or brick or block and related equipment is required. Because only a line of mortar is used, the holes in the brick or block are free for receiving steel reinforcing bars and the like for strengthening the wall construction. The new wall construction method is well suited for use in earth quake areas.

Still another object of the new method is novice or unskilled workman can quickly build a brick or block wall that is straight, level and plumb thereby eliminating the need for skilled craftsman. The wall can be build at a greatly reduced cost due to savings in time and labor.

Yet another object of the invention is the wall can be started at any part of the building i.e. a corner, a center, etc. Further, a minimum of scaffolding is required using this type of wall construction.

A further object of the invention is the new wall construction method uses light weight wall panels which are used as a guide during the brick or block laying. The wall panels provide a means for keeping the new wall plumb, straight and level. The wall panels eliminate the need for having to continuously having to use a hand level or plumb line to double check if the wall is level or plumb as the bricks or blocks are laid course after course. Also, wall and door panels can be attached to the side of a wall panel for ease in installation.

The new method of forming a structural wall using either lightweight or heavyweight block or brick and using lightweight removable wall panels includes first installing one or more removable wall panels vertically next to a chalk line on a building foundation. The chalk line is used to mark a horizontal line along one side of the wall to be constructed. The wall panel is plumbed vertically and leveled horizontally. The wall panel includes horizontal level lines 8 inches, 2 feet and 6 feet from a bottom of the wall panel. The level lines are used as a level guide to make sure each row or course of blocks are level as a block wall is built upwardly. This method as described herein will apply equally well to building a brick wall. Also, the bottom of the wall panel is used as leveling device for the floor or foundation.

A bonding agent is now placed on the bottom and one side of a plurality of concrete blocks for forming a first course of bricks. The blocks are then laid end to end next to each other and next to one side of the wall panel for forming a first row of blocks. The bonding agent is now applied to the top of the first row of blocks. The bonding agent is now applied to the ends of a plurality of concrete blocks for forming a second row of blocks. The blocks are then laid end to end next to each other on top of the first row of blocks for forming a second row of blocks. The applying of the bonding agent to the blocks and laying courses of blocks one on top of each other is continued upwardly until the top of the last course of blocks coincides with the top of the wall panel.

These and other objects of the present invention will become apparent to those familiar with brick and block wall construction and the problems associated therewith from the following detailed description, showing novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENTS

Figure 1:
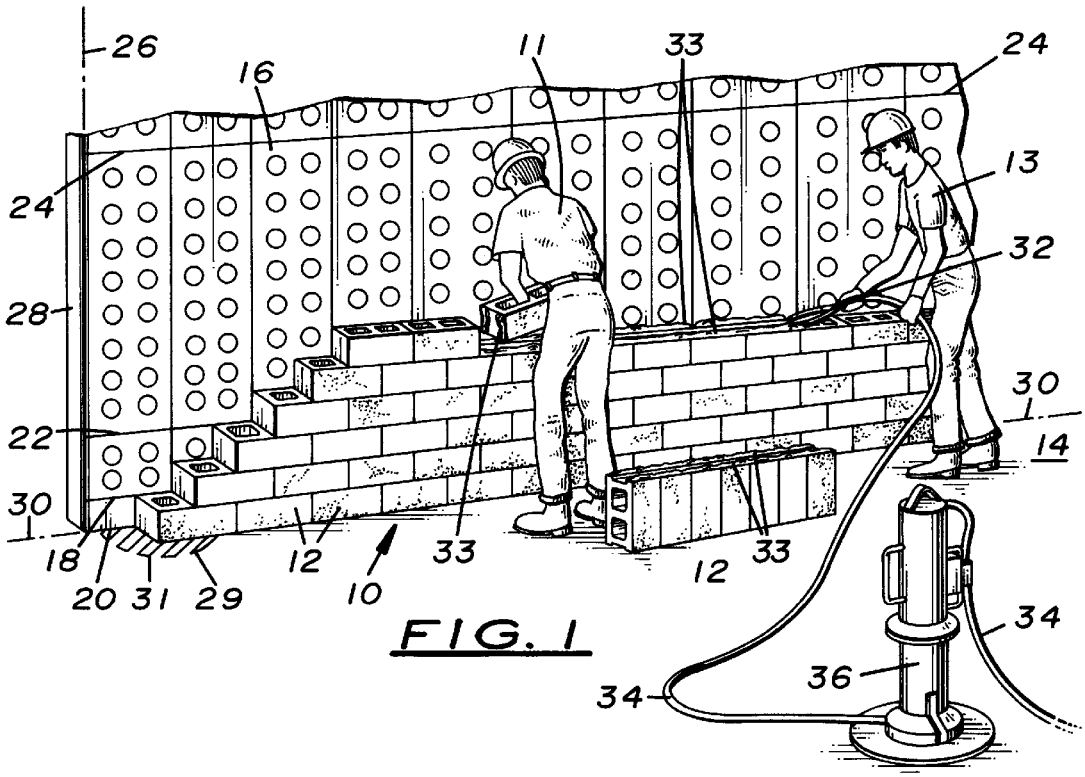
FIG. 1 is a perspective view of a pair of workman practicing the subject method of forming a structural wall using either lightweight or heavy weight blocks. The new wall is formed on a horizontal foundation using a removable lightweight wall panel as a guide to keep the wall plumb, straight and level during the laying of each row or course of blocks. In this drawing, one workman is shown applying a bonding agent on top of a course of blocks. A second workman is shown setting a block on top of a course of blocks with bonding agent thereon. The block is also placed next to a block already laid.

In FIG. 1, a perspective view of a pair of workman 11 and 13 practicing the subject method of forming a structural wall using block is illustrated. The new wall is shown having a general reference numeral 10 and constructed using a plurality of blocks 12 typically having a length of 12 inches, a height of 8 inches and a width of 8 inches. While the blocks 12 are described herein, it should be kept in mind that various types of blocks and bricks can also be used equally well in the construction of wall 10.

The new wall 10 is formed, in this example, on a horizontal concrete pad 14. Mounted vertical along one side of the concrete pad 14 is a removable lightweight wall panel 16. The wall panel 16 is designed so that a pair of workman can easily lift, set up and move the panel 16 during the wall construction. In the drawings, the wall panel 16 is shown having a pattern of holes therein to reduce the overall weight. It should be kept in mind that various types of material can be used in the construction of the panel 16 to reduce its weight for ease in set up and moving.

The wall panel 16 is used as a guide to keep the wall 10 plumb, straight and level during the laying of each course of blocks. Also, the wall panel 16 includes a horizontal level line 18 at 8 inches from a bottom 20 of the wall panel 16. Further, the wall panel 16 includes a horizontal level line 22 at 2 feet from the bottom 20 of the panel 16 and a horizontal level line 24 at 6 feet from the bottom 22 of the panel 16.

A vertical plumb line 26 is shown in dashed lines and along a left side 28 of the wall panel 16 to made sure the sides of the wall panel 16 are vertical. Also, a horizontal chalk line 30 is shown in dashed lines and along the bottom 20 of the panel 16. The horizontal chalk line 30 is used to mark one side of the wall 10 to be constructed with one side of the bottom 20 of the panel 16. The bottom 20 of the panel 16 is positioned along the chalk line 30 as a guide during the construction of the new wall 10. It should be noted that the plumbing and leveling of the wall panel 16 is extremely important at the start of the construction of the wall 10. This is true, since if the panel 16 is not plumb or is not level, then the wall 10 will not be plumb or level.

Also, if the concrete pad 14 is not completely level along the length of the chalk line 30, then a filler material 29, shown as parallel lines, and the like can be added to the top of the pad 14 so that the first course of blocks 12 laid along the length of the chalk line 30 is completely level. In this drawing a low spot 31, shown in dotted lines, is illustrated in the concrete pad 14 and next to the wall panel 16. To make sure the first course of blocks 12 is level, the low spot 31 is covered with the filler material 29. Should the low spot 31 occur in the foundation pad 14 next to one end of the wall panel 16, the opposite end of the wall panel 16 would be used as a point for leveling the wall panel 16 and the low spot 31 would be filled in order to have a complete level surface for the first course of blocks 12.

In this drawing, the workman 13 is shown applying a bonding agent 33 using a hand operated forked tool 32. The forked tool 32 is connected to a supply hose 34 which is connected to a bonding agent pump 36. When the forked tool 32 is turned "on" by the workman 13 using a hand valve, the pump 36 supplies the bonding agent 33 to the forked tool 32 which in turn applies a thin bead of bonding agent along parallel lines and on opposite sides of the top of the blocks 12. In this example, the top of a sixth course or row of blocks 12 is receiving an application of the bonding agent 33. It can be seen in this drawing, five courses of blocks 12 have already been laid. Note, the blocks 12 on the left side of the wall 10 have been laid is a stair-step fashion. Additional blocks 12 will be laid at a later time to complete the left side of the wall 10.

Also, in this drawing, the workman 11 is shown setting a block 12 on top of a fifth course of blocks 12 with the bonding agent 33 already applied on top of the 5th course by the workman 13. The block 12, being laid by the workman 11, includes the bonding agent 33 on the left end of the block 12 for engaging and bonding to the block 12 already laid.

To the back of the workman 11, is a row of blocks 12 which have been laid end to end by a third workman whose job is to supply the workmen 11 and 13 continuously with blocks 12. The third workman is not shown in the drawings. When the blocks 12 have been laid end to end as shown, the workman 13 using his forked bonding agent application 32, applies bonding agent 33 to the upper ends of the blocks 12 as shown. In this manner, each block 12 is ready for the workman 11 to quickly lift a block 12 with bonding agent 33 already applied to the end thereof and set the block 12 next to the previously laid block 12 as shown. From reviewing the above method of laying the blocks 12 with the wall panel 16 as a guide, it can be appreciated that the three workman working together can quickly and efficiently lay a plumb, level and a straight wall 10 at far less time when compared to current methods of laying block and bricks walls.

It should be pointed out that throughout this discussion of the subject method of laying blocks and bricks, the bonding agent 33 is shown used with the blocks 12. Also the blocks 12 can be used with the panel 16 using a method of dry stacking for wall construction. This method of building a wall 10 is used without any bonding agents, mortar and the like and the various courses of blocks 12 are stacked one on top of each other as shown in the drawings.

Figure 2:
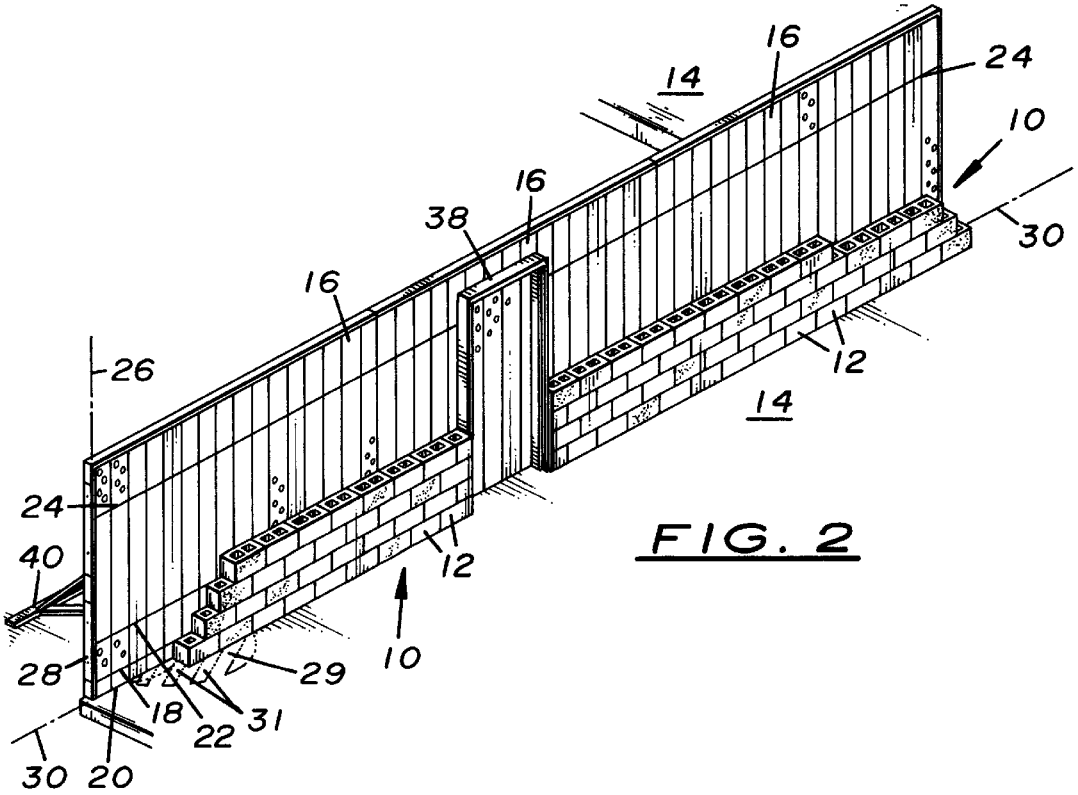
FIG. 2 is a perspective view and illustrates a partially built block wall formed next to a series of three lightweight wall panels which have been plumbed vertically and leveled horizontal as a guide for forming each course of blocks. A door frame is shown attached to one of the wall panels with the blocks formed therearound.

In FIG. 2, a perspective view of a partially built block wall 10 is illustrated and formed next to a series of three lightweight wall panels 16. The panels 16 are held upwardly in a vertical position by telescoping rods 40 attached to the back of the panels. While three panels 16 are shown, it should be kept in mind that any number of panels can be used depending on the length of the wall to be built.

The wall panels 16 have been plumbed vertically using plumb line 26 and leveled horizontally using chalk line 30. In this drawing, four courses of block 12 have been laid. Also shown in this drawings is a door frame 38 shown attached to the middle wall panel 16 with the blocks 12 being formed therearound. Note in this drawing, as the wall 10 is built, the workmen can double check the level of the course of blocks 12. For example, when the first course of blocks 12 is completed, with the height of each block being approximately 8 inches, the top of the first course of blocks 12 should correspond with the horizontal level line 18. This double checking of the level of the wall will help insure that at the very start of the wall 10, it is level. Likewise, when the third course of blocks 12 is completed, the top of this course can be double checked to see if it is corresponds with the horizontal level line 22, which is 24 inches above the bottom 20 of the wall panel 16.

Figure 3:
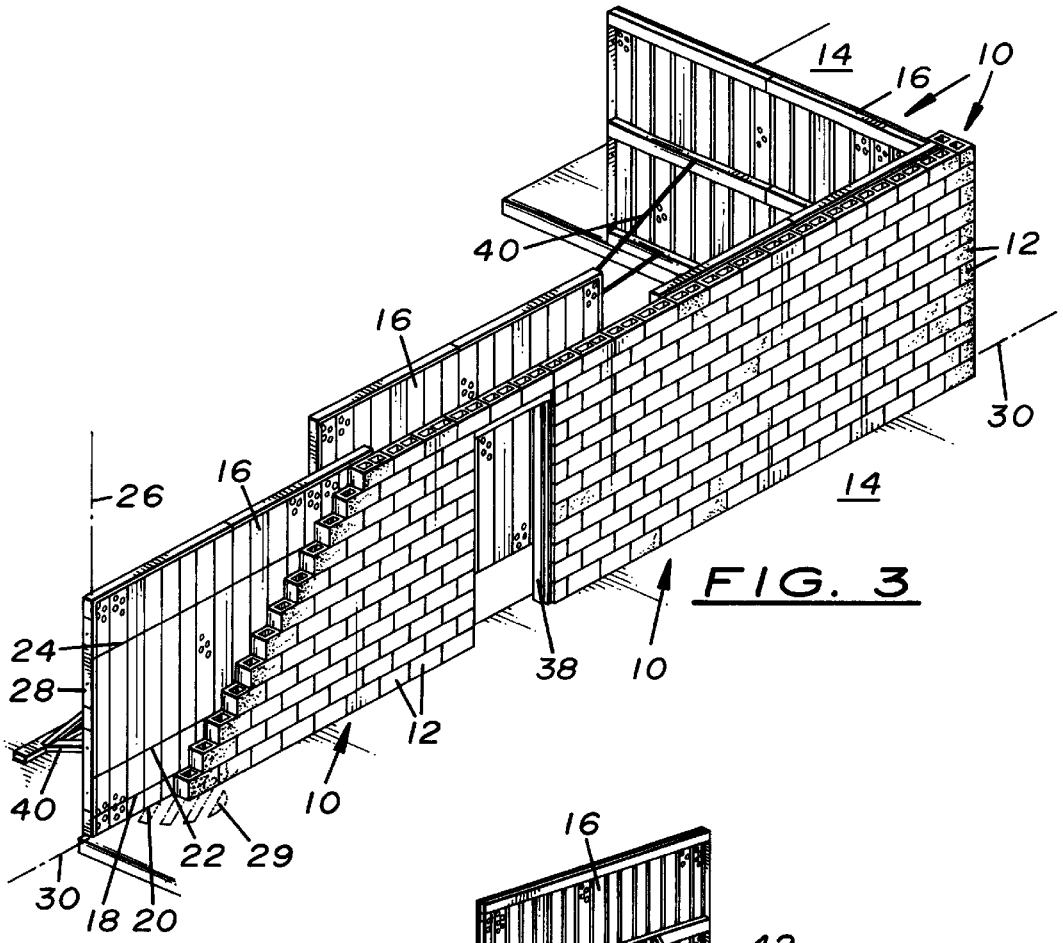
FIG. 3 is a perspective view and illustrates the block wall shown in FIG. 2 and formed upwardly to the top of two of the wall panels. A second wall is shown being formed at right angles to one end of the new block wall. Also, a middle wall panel is shown being removed from the center of the new block wall since this portion of the wall has been completed.

In FIG. 3, a perspective view of a partially completed the block wall 10 is shown formed upwardly to the top of two of the panels 16. A second wall 10 is shown ready to be formed next to a wall panel 16. This wall panel is at right angles to the three other wall panels 16. Also, the middle wall panel 16 is shown being removed from the center of the newly created block wall 10.

Figure 4:
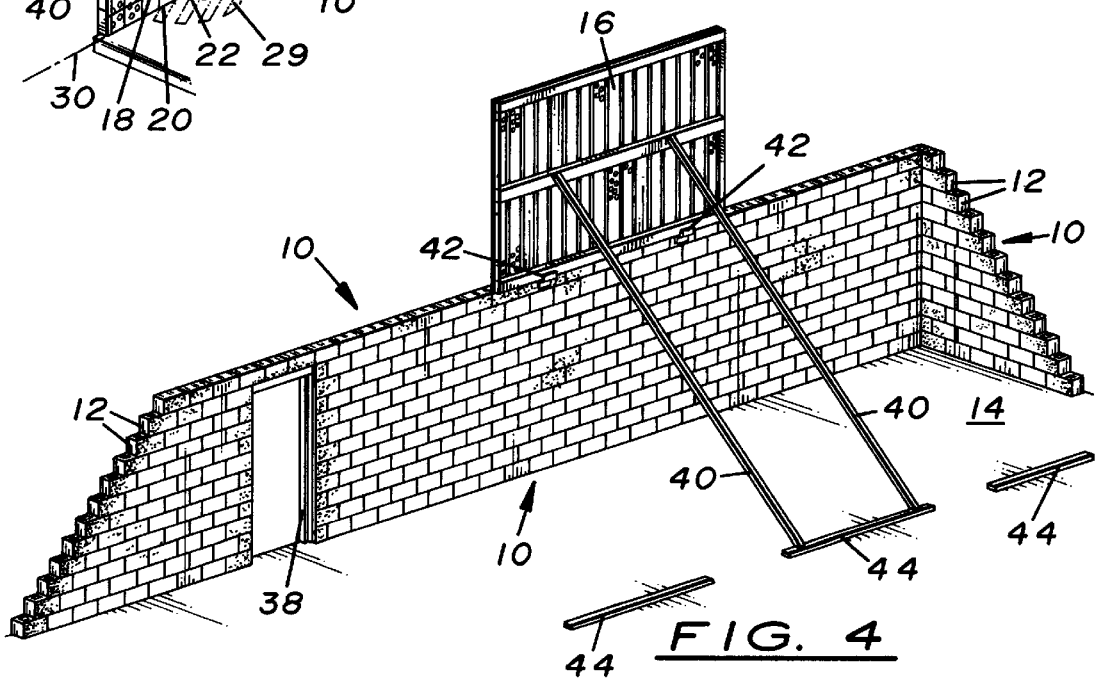
FIG. 4 is a perspective view and illustrates the use of a second story wall panel mounted on a pair of wall panel brackets attached to a top of the block wall. The second story wall panel is used in conjunction with scaffolding to build a second story block wall.

In FIG. 4, a perspective view is shown of the back of the wall 10 as constructed in FIGS. 1–3. In this drawing, the use of a second story wall panel 16 is shown mounted vertically on a pair of wall panel brackets 42 for engaging the bottom 20 of the panel 16. The two wall panel brackets are releasably attached to the top course of the completed wall 10. The second story wall panel 16 will be used in conjunction with scaffolding to build a second story block wall 10. The wall scaffolding is not shown in the drawings. In this view, the telescoping rods 40 are shown with one end attached to the second story wall panel 16 and the opposite end secured to ground anchors 44.

Figure 5:
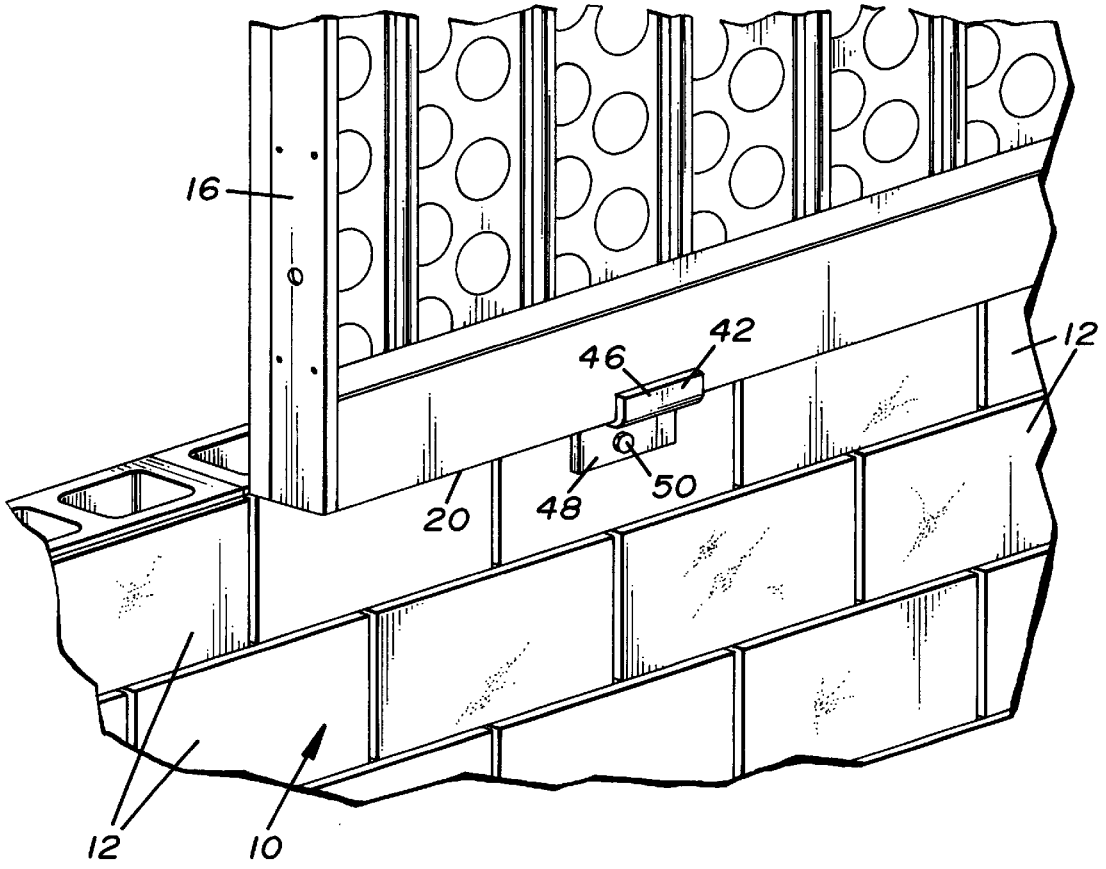
FIG. 5 is an enlarged perspective view and illustrates a wall panel bracket attached to a portion of a top of a completed block wall for holding a wall panel vertically and forming a second story structural block wall.

In FIG. 5, an enlarged perspective view of one of the wall panel bracket 42 is shown. In this drawing, the wall panel bracket 42 can seen with a "L" shaped flange 46 attached to a portion of the bottom 20 of the panel 16. Also the bracket 42 includes a vertical flange 48 with bolt 50 attached to a top portion of a block wall 10. In this manner, the wall panel brackets 42, as shown, are used holding a wall panel vertically and forming a second story structural block wall 10.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

The embodiments of the invention for which an exclusive privilege and property right is claimed are defined as follows:

1. A method of forming a structural wall using lightweight or heavyweight blocks or bricks and in conjunction with a removable lightweight wall panel, the wall panel used as a guide for forming the wall, the wall formed using a hand held tool for delivering under pressure a bonding agent on the blocks or bricks, the steps comprising:

installing the removable wall panel vertically on top of a structural member, the structural member being one of a footing, a foundation, a concrete pad, caissons and a floor;

plumbing vertically the wall panel and leveling horizontally the wall panel on top of the structural member;

applying a line of bonding agent on top of the structural member and next to a length of the removable wall panel;

applying parallel lines of bonding agent using the hand held tool to one end of a series of first blocks prior to laying a first course of first blocks on the structural member;

laying the first course of first blocks end to end and on top of the bonding agent on the structural member, the first course of first blocks laid next to the wall panel; and applying parallel lines of bonding agent using the hand held tool on opposite sides of the top of the first course of the first blocks.

2. The method as described in claim 1 further including the steps of:

applying parallel lines of bonding agent using the hand held tool to one end of a series of second blocks prior to laying a second course of blocks;

laying a second course of second blocks end to end and on top of the bonding agent on the first course of first blocks; and applying parallel lines of bonding agent using the hand held tool on opposite sides of the top of the second course of the second blocks.

3. The method as described in claim 2 further including the steps of:

applying parallel lines of bonding agent using the hand held tool to one end of a series of third blocks prior to laying a third course of blocks;

laying a third course of third blocks end to end and on top of the bonding agent on the second course of the second blocks; and applying parallel lines of bonding agent using the hand held tool on opposite sides of the top of the third course of the third blocks.

4. The method as described in claim 1 further including after the step of plumbing and leveling the wall panel, a step of filling in any low spot in the structural member next to the wall panel with a filler material and prior to laying the first course of first blocks.

5. The method as described in claim 1 wherein said wall panel includes a door frame attached thereto and the step of laying a series of first blocks end to end and on top of the bonding agent includes the laying of the first course of first blocks up to the door frame.

6. A method of forming a structural wall using lightweight or heavyweight blocks or bricks and in conjunction with a removable lightweight first wall panel connected to a second wall panel, the wall panels used as a guide for forming the wall, the wall formed using a hand held tool for delivering under pressure a bonding agent on the blocks or bricks, the steps comprising:

installing the removable first and second wall panels vertically on top of a structural member, the structural member being one of a footing, a foundation, a concrete pad, caissons and a floor;

plumbing vertically the first and second wall panels and leveling horizontally the wall panels on top of the structural member;

applying a line of bonding agent on top of the structural member and next to a length of the removable first and second wall panels;

applying parallel lines of bonding agent using the hand held tool to one end of a series of first blocks prior to laying a first course of first blocks on the structural member;

laying the first course of first blocks end to end and on top of the bonding agent on the structural member, the first course of first blocks laid next to the first and second wall panels; and applying parallel lines of bonding agent using the hand held tool on opposite sides of the top of the first course of the first blocks.

7. The method as described in claim 6 further including the steps of:

applying parallel lines of bonding agent using the hand held tool to one end of a series of second blocks prior to laying a second course of blocks;

laying a second course of second blocks end to end and on top of the bonding agent on the first course of first blocks; and applying parallel lines of bonding agent using the hand held tool on opposite sides of the top of the second course of the second blocks.

8. The method as described in claim 7 further including the steps of:

applying parallel lines of bonding agent using the hand held tool to one end of a series of third blocks prior to laying a third course of blocks;

laying a third course of third blocks end to end and on top of the bonding agent on the second course of the second blocks; and applying parallel lines of bonding agent using the hand held tool on opposite sides of the top of the third course of the third blocks.

9. The method as described in claim 6 further including after the step of plumbing and leveling the first and second wall panels, a step of filling in any low spot in the structural member next to the wall panels with a filler material and prior to laying the first course of first blocks.

10. A method of forming a structural wall using lightweight or heavyweight blocks or bricks and in conjunction with a removable lightweight first wall panel connected to a second wall panel, the wall panels used as a guide for forming the wall, the wall formed using a hand held tool for delivering under pressure a bonding agent on the blocks or bricks, the steps comprising:

installing the removable first and second wall panels vertically next to a chalk line formed on a structural member, the structural member being one of a footing, a foundation, a concrete pad, caissons and a floor;

plumbing vertically the first and second wall panels and leveling horizontally the wall panels on top of the structural member and next to the chalk line;

applying a line of bonding agent on top of the structural member and next to a length of the removable first and second wall panels;

applying parallel lines of bonding agent using the hand held tool to one end of a series of first blocks prior to laying a first course of first blocks on the structural member;

laying the first course of first blocks end to end and on top of the bonding agent on the structural member, the first course of first blocks laid next to the first and second wall panels; and applying parallel lines of bonding agent using the hand held tool on opposite sides of the top of the first course of the first blocks.

11. The method as described in claim 10 further including the steps of:

applying parallel lines of bonding agent using the hand held tool to one end of a series of second blocks prior to laying a second course of blocks;

laying a second course of second blocks end to end and on top of the bonding agent on the first course of first blocks; and applying parallel lines of bonding agent using the hand held tool on opposite sides of the top of the second course of the second blocks.

12. The method as described in claim 11 further including the steps of:

applying parallel lines of bonding agent using the hand held tool to one end of a series of third blocks prior to laying a third course of blocks;

laying a third course of third blocks end to end and on top of the bonding agent on the second course of the second blocks; and applying parallel lines of bonding agent using the hand held tool on opposite sides of the top of the third course of the third blocks.

13. The method as described in claim 10 further including after the step of plumbing and leveling the first and second wall panels, a step of filling in any low spot in the structural member next to the wall panels with a filler material and prior to laying the first course of first blocks.

14. The method as described in claim 10 wherein the first wall panel is disposed at a right angle to the second wall panel and wherein a portion of the first course of first blocks are disposed at right angles to a remaining portion of the first course of first blocks.

15. The method as described in claim 10 wherein said first wall panel includes a door frame attached thereto and the step of laying a series of first blocks end to end and on top of the bonding agent includes the laying of the first course of first blocks up to the door frame.

* * * * *